US012497749B2

(12) United States Patent
Linley

(10) Patent No.: US 12,497,749 B2
(45) Date of Patent: Dec. 16, 2025

(54) MODULAR DANGLE SUPPORT FOR USE WITH AN ARTICULATING BOOM

(71) Applicant: Jason Linley, Fort St John (CA)

(72) Inventor: Jason Linley, Fort St John (CA)

( * ) Notice: Subject to any disclaimer, the term of this patent is extended or adjusted under 35 U.S.C. 154(b) by 900 days.

(21) Appl. No.: 17/107,086

(22) Filed: Nov. 30, 2020

(65) Prior Publication Data

US 2022/0170232 A1 Jun. 2, 2022

(51) Int. Cl.
*E02F 3/36* (2006.01)
*E02F 3/96* (2006.01)

(52) U.S. Cl.
CPC ..... *E02F 3/3677* (2013.01); *E02F 3/96* (2013.01)

(58) Field of Classification Search
CPC ..... E02F 3/3604–3686; E02F 3/962; E02F 3/3609; E02F 3/96; E02F 3/966; E02F 3/967; E02F 3/968; A01D 34/866; E02D 2600/20
USPC ..... 37/403, 406; 414/723, 734; 248/324; 239/397
See application file for complete search history.

(56) References Cited

U.S. PATENT DOCUMENTS 3,749,262 A * 7/1973 Stark ..... E02F 3/961 172/438
3,807,802 A * 4/1974 Betters ..... E02F 3/962 37/405
3,822,730 A * 7/1974 Hultdin ..... A01G 23/08 144/34.1
4,805,707 A * 2/1989 Davis ..... E02F 3/966 248/580
8,076,889 B2 * 12/2011 Lai ..... F16M 11/2021 700/250
9,022,339 B2 * 5/2015 Borg ..... H02G 3/0493 248/323
2009/0084005 A1 * 4/2009 Ramun ..... E02F 3/3604 37/468
2010/0037490 A1 * 2/2010 Scruggs ..... A61G 17/044 37/189
2013/0051964 A1 * 2/2013 Bernier ..... E02F 3/96 414/722
2018/0038062 A1 * 2/2018 Weaver ..... E02F 3/3686
2021/0388576 A1 * 12/2021 King ..... E02F 5/025

FOREIGN PATENT DOCUMENTS

CN 214025447 U * 8/2021
JP 08218413 A * 8/1996 ..... E02F 3/3609

OTHER PUBLICATIONS https://www.diggausa.com/piling-drilling-extension-mount.php, Digga North America Machinery Attachments: Piling & Drilling Mounts, Dyersville Iowa, pp. 1-2.

* cited by examiner

*Primary Examiner* — Gerald McClain

(57) ABSTRACT

A modular dangle support for an articulating boom includes at least two modules a spar module and a dangle head module. The spar module has a first end and a second end. The first end has a coupling. The second end has an articulated boom mounting, whereby the spar module is attached to an articulated boom. The dangle head module is detachably secured by the coupling to the first end of the spar module. It is anticipated that there will be more than one dangle head module, with only one dangle head module being used at any one time. Dangle head modules are changed to accommodate different dangle head configurations and different load capacities.

11 Claims, 6 Drawing Sheets

MODULAR DANGLE SUPPORT FOR USE WITH AN ARTICULATING BOOM

FIELD

There is described a modular dangle support that is used to suspend a working head from an articulating boom.

BACKGROUND

A working head is said to be a "dangle head", when it is suspended from an articulating boom so that it "dangles". Examples of working heads that "dangle" are grapples, reciprocating or vibrating hammers, rotary top drives and pile drivers.

There are dangle supports that are commercially available for use with an articulating boom. These dangle supports are generally "use specific" and are custom engineered to suit attributes of a particular application.

SUMMARY

There is provided a modular dangle support for an articulating boom. The modular dangle support includes at least two modules a spar module and a dangle head module. The spar module consists of at least one cylindrical tubular body. The spar module has a first end and a second end. The first end has one of a male coupling or a female coupling. The second end has an articulated boom mounting, whereby the spar module is attached to an articulated boom. The dangle head module is detachably secured to the first end of the spar module. The dangle head module has one of a male coupling or a female coupling which mates with the male coupling or the female coupling at the first end of the spar, thereby supporting a dangle head at the first end of the spar.

The utility of the modular dangle support will become apparent from the description which follows. It is anticipated that there will be more than one dangle head module, with only one dangle head module being used at any one time. Some dangle head modules will accommodate different dangle head configurations. Some dangle head modules will accommodate different load capacities. The use of dangle head modules, as described enable a quick change at a job site. This may arise when changing from a rotary top drive application, to a reciprocating hammer or a grapple application. This may arise when changing from a rotary top drive of one load and torque capacity to a rotary top drive having a differing load and torque capacity.

It will be appreciated that the spar module need not be a singular cylindrical tubular body of a fixed length. There is an advantage in being able to add another cylindrical tubular body to increase the length of the spar module or, conversely, removing one or more cylindrical tubular body to decrease the length of the spar module.

If the modular dangle support is always used with the same articulated boom, there is no need to change the articulated boom mounting. However, where the modular dangle support is going to be used with different articular booms, mounting plate modules can be detachably secured to the articular boom mounting. The mounting plate modules accommodate different mounting bracket configurations found on different articulated booms, with only one mounting plate module being used at any one time.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
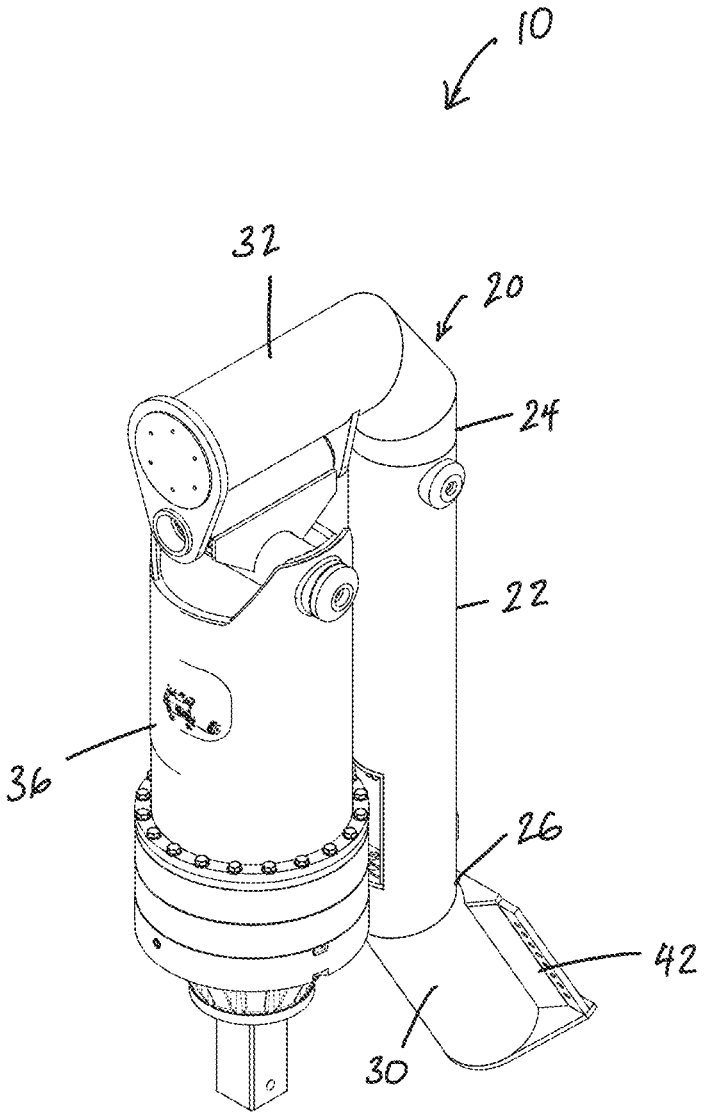
FIG. 1 is a perspective view of a modular dangle support shown used with a first dangle head module suitable for a first rotary top drive configuration.

A modular dangle support for use with an articulating boom, the modular dangle support generally identified by reference numeral 10, will now be described with reference to FIG. 1 through FIG. 7.

Figure 6:
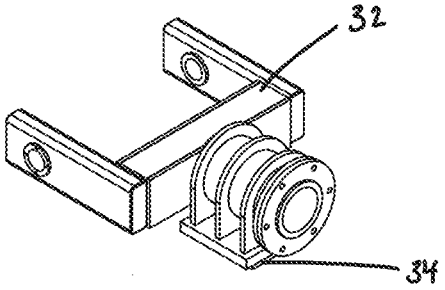
FIG. 6 is an exploded side elevation view of a modular dangle support, a spar and mounting plate module.
Figure 6:
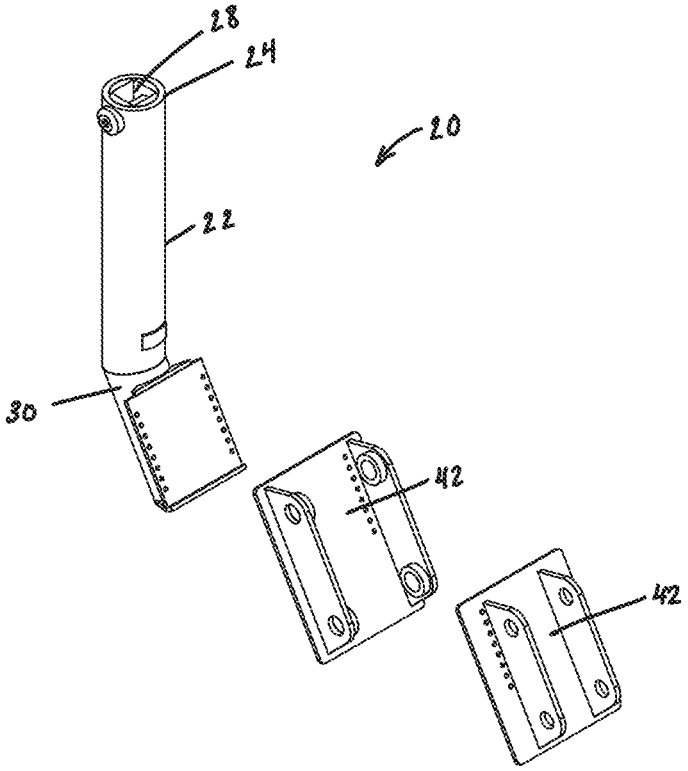

Structure and Relationship of Parts:

Referring to FIG. 1, a modular dangle support 10 includes a spar module 20. Spar module 20 includes one cylindrical tubular body 22. Spar module 20 has a first end 24 and a second end 26. Referring to FIG. 6, first end 24 has a first coupling 28 (a female coupling is illustrated, but a male coupling could be used). Referring back to FIG. 1, second end 26 has an articulated boom mounting 30, whereby spar module 20 is attached to an articulated boom (not shown).

A dangle head module 32 is detachably secured to first end 24 of spar module 20. Referring to FIG. 6, dangle head module 32 has a second coupling 34 (a male coupling is presumed, but a female coupling could be used) which mates with first coupling 28 at first end 24 of spar module 20. As illustrated in FIG. 1, this arrangement supports a dangle head 36 at first end 24 of spar module 20.

Figure 2:
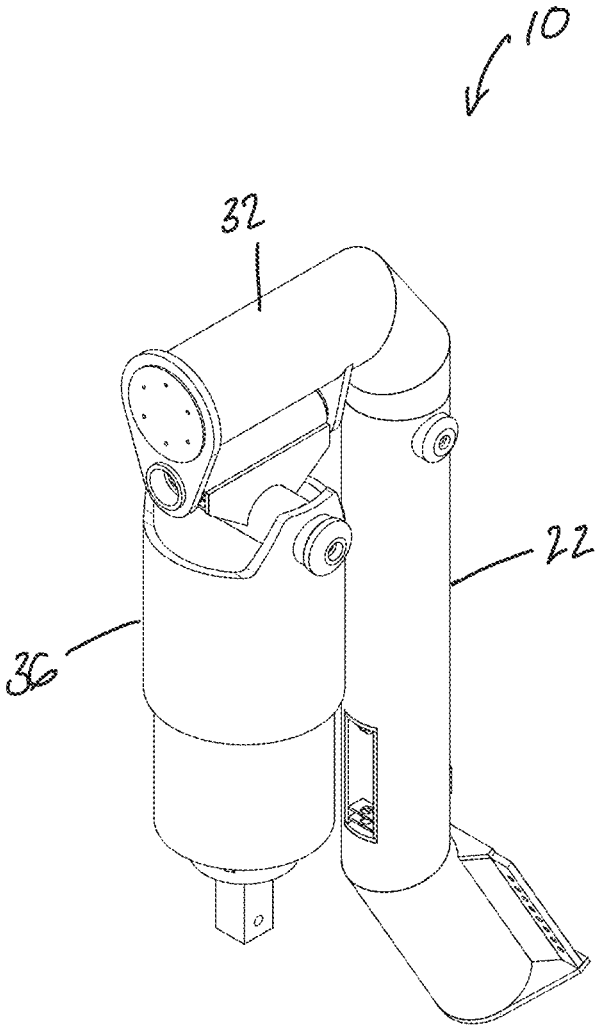
FIG. 2 is a perspective view of the modular dangle support shown used with second dangle head module suitable for a second rotary top drive configuration.
Figure 3:
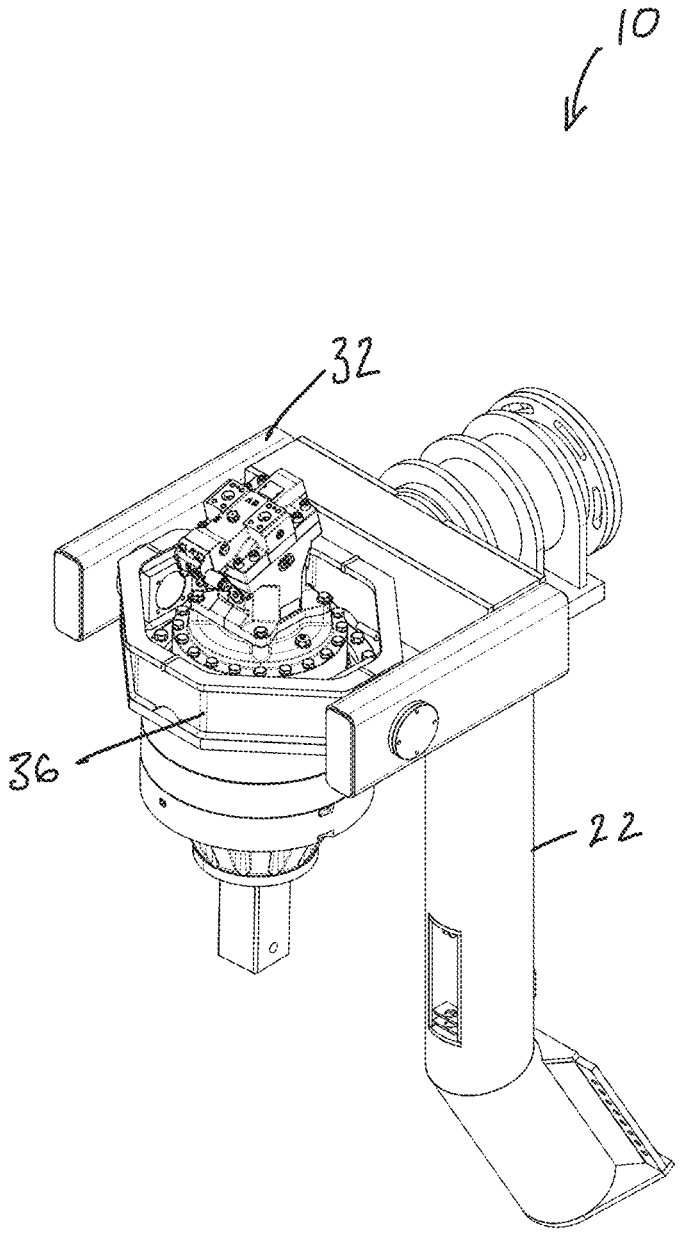
FIG. 3 is a perspective view of the modular dangle support shown used with a third dangle head module suitable for a third rotary top drive configuration.
Figure 4:
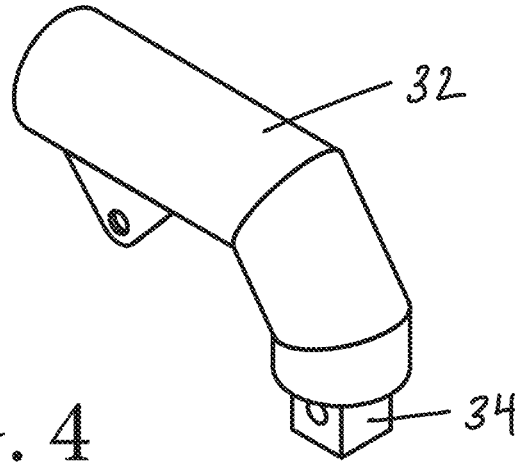
FIG. 4 is a side elevation view of a fourth dangle head module.
Figure 5:
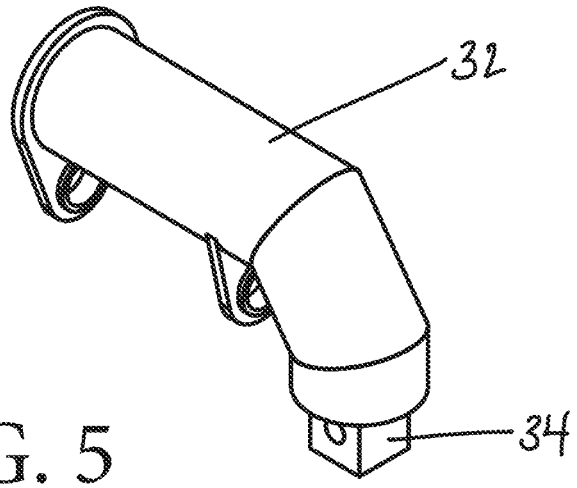
FIG. 5 is a side elevation view of a fifth dangle head module.

FIG. 1 is a rotary drive unit. Referring to FIG. 2, FIG. 3, FIG. 4 and FIG. 5, it will be appreciated that more than one dangle head module 32 can be used with modular dangle support 10. Different dangle head modules 32 exist to accommodate different dangle head 36 configurations or different load capacities. FIG. 2 shows another rotary drive dangle head that is the same basic configuration as FIG. 1, but has a different load and torque capacity. FIG. 3 illustrates a U-bracket dangle head module 32, to show how a different dangle head configuration could be used with a rotary drive. FIG. 4 illustrates a dangle head module 32 that can accommodate a reciprocating or vibrating hammer. FIG. 5 illustrates a dangle head module 32 that can accommodate a screw pile dangle head. Many other configurations are possible. However, only one dangle head module 32 can be used with modular dangle support 10 at any one time. Such a modular system is advantageous as it allows for ease of servicing of parts without decommissioning the whole system. Further, other advantages exist in that different dangle heads 36 for different purposes could be swapped in and out on site as needed.

Referring to FIG. 6, it will be appreciated that spar module 20 need not be a singular cylindrical tubular body of a fixed length. Although only one cylindrical tubular body 22 is illustrated, it will be appreciated that two or more cylindrical tubular bodies 22 could be added to spar module 20 to accommodate different desired lengths for spar module 20. Being able to add in and take out any number of cylindrical tubular bodies 22 will allow spar module 20 to be adapted to any length required to accommodate longer piles or loads with the same size excavator. This is advantageous in that a user does not need to employ a larger model excavator with a longer reach.

Figure 7:
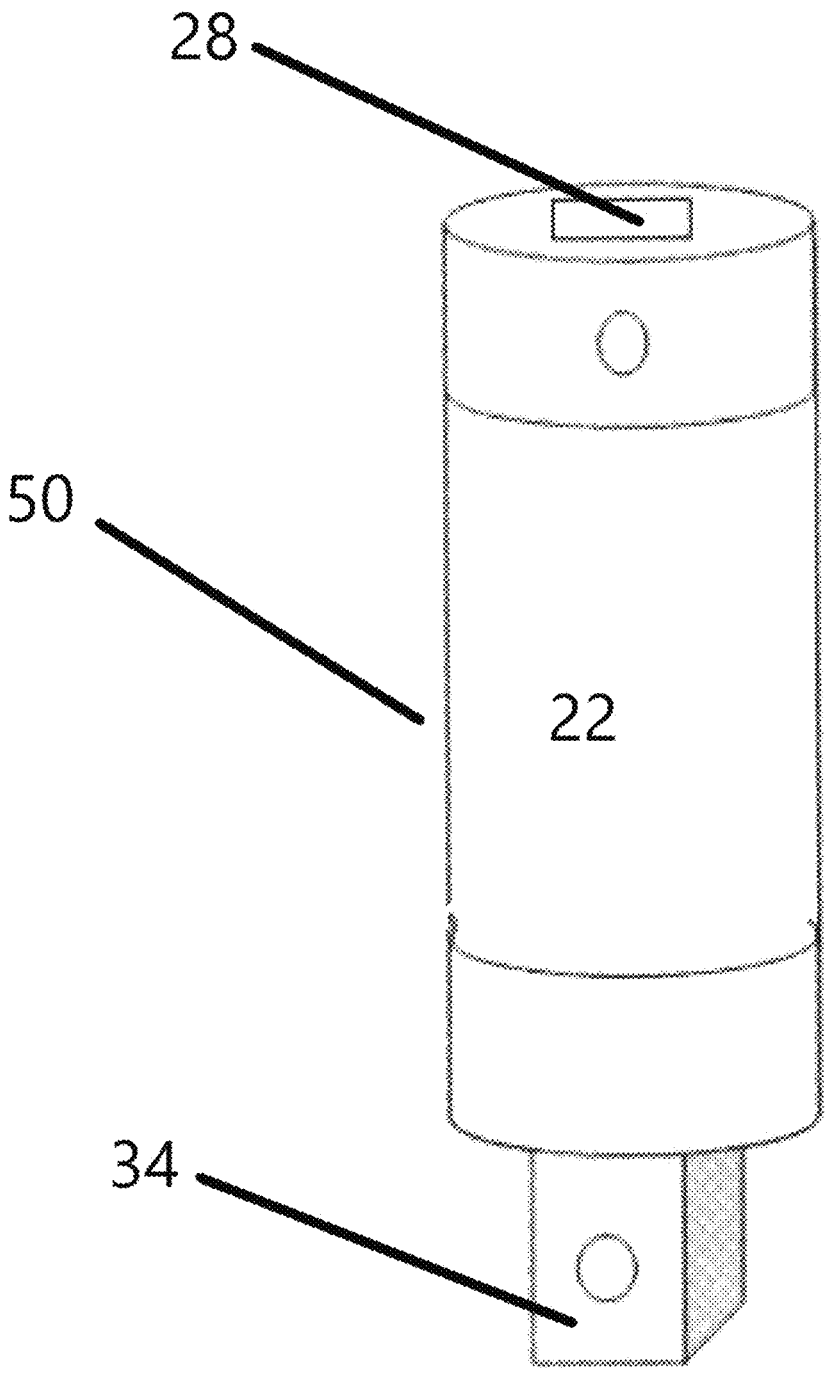
FIG. 7 is a side elevation view of a spar extension module.

Referring to FIG. 7, there is illustrated a spar extension that can be added to increase the length of spar module 20 in FIG. 6. Spar extension module 50 has a cylindrical tubular body 22, a first coupling 28 (a female coupling is illustrated) and a second coupling 34 (a male coupling is illustrated).

Referring to FIG. 6, two different mounting plate modules 42 are illustrated. Either mounting plate module 42 could be detachably secured to articulated boom mounting 30, however only one can be secured at any given time. It will be appreciated that different mounting plate modules 42, beyond the two illustrated for demonstrative purposes, are available to accommodate different mounting bracket configurations on the excavator (not shown). The different mounting plate modules 42 will allow modular dangle support 10 to be mounted to any make or model of excavator that exists.

Operation:

In use, modular dangle support 10 is mounted to an excavator of the user's choice via mounting plate module 42. Referring to FIG. 6, different mounting plate modules 42 may be swapped in and out of articulated boom mounting 30 to attach modular dangle support 10 to any make or model of excavator. Referring to FIG. 1 through FIG. 6, a user may swap in and out various dangle head modules 32 depending on the type of dangle head 36 that is required to do the job intended. Referring to FIG. 6 and FIG. 7, any number of cylindrical tubular bodies 22 may be used by adding to removing spar extension 50 from spar module 20 to increase or decrease the height of modular dangle support 10, as needed to do the job intended. The dangle head modules 32 and cylindrical tubular bodies 22 can all be easily swapped in and out of modular dangle support 10 through connecting and disconnecting the male and female coupling parts.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. A modular dangle support, comprising:

a dangle head;

a spar module comprised of at least one cylindrical tubular body extending between a first end and a second end, a first coupling defined at the first end, an articulated boom mounting defined at the second end to attach the at least one cylindrical tubular body to an articulated boom; and a dangle head module connected to the dangle head and defining a second coupling that engages the first coupling to detachably secure the at least one cylindrical tubular body to the dangle head module and to support the dangle head proximal to the first end.

2. The modular dangle support of claim 1, wherein the at least one cylindrical tubular body includes more than one cylindrical tubular body connected to each other to form a continuous tubular body.

3. The modular dangle support of claim 1, wherein a first cylindrical tubular body of the at least one cylindrical tubular body defines one of a male coupling or a female coupling which mates the male coupling or the female coupling of a second cylindrical tubular body of the at least one cylindrical tubular body.

4. The modular dangle support of claim 1, wherein a mounting plate module is detachably secured to the articulated boom mounting, there being different mounting plate modules to accommodate different mounting bracket configurations.

5. The modular dangle support of claim 1, wherein there is more than one dangle head module, each dangle head module accommodating a different dangle head configuration, only one of the more than one dangle head modules being used at any one time.

6. The modular dangle support of claim 1, wherein there is more than one dangle head module, each dangle head module having a different capacity, only one of the more than one dangle head modules being used at any one time.

7. The modular dangle support of claim 1, wherein the at least one cylindrical tubular body is a singular cylindrical tubular body of fixed length extending between the first end and the second end.

8. A modular dangle support, comprising:

a dangle head;

a spar module comprised of at least one cylindrical tubular body extending between a first end and a second end, one of a male coupling or a female coupling being defined at the first end, articulated boom mounting defined at the second end to attach the at least one cylindrical tubular body to an articulated boom; and a dangle head module connected to the dangle head and defining one of a male coupling or a female coupling which mates with the male coupling or the female coupling of the spar module to detachably secure the at least one cylindrical tubular body to the dangle head module and to support the dangle head proximal to the first end;

wherein there is more than one dangle head module, each dangle head module accommodating a different dangle head configuration or having a different load capacity, only one of the more than one dangle head modules being used at any one time.

9. The modular dangle support of claim 8, wherein a mounting plate module is detachably secured to the articulated boom mounting, there being different mounting plate modules to accommodate different mounting bracket configurations.

10. The modular dangle support of claim 8, wherein the at least one cylindrical tubular body includes a first cylindrical tubular body and a second cylindrical tubular body, the first cylindrical tubular body having one of a male coupling or a female coupling which mates the male coupling or the female coupling of the second cylindrical tubular body.

11. The modular dangle support of claim 8, wherein the at least one cylindrical tubular body is a singular cylindrical tubular body of fixed length extending between the first end and the second end.

* * * * *